US011782359B2

(12) United States Patent
Okamoto

(10) Patent No.: US 11,782,359 B2
(45) Date of Patent: Oct. 10, 2023

(54) DEVELOPER STORING APPARATUS AND IMAGE FORMING APPARATUS

(71) Applicant: KYOCERA Document Solutions Inc., Osaka (JP)

(72) Inventor: Kazuhiro Okamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/990,538

(22) Filed: Nov. 18, 2022

(65) Prior Publication Data

US 2023/0168606 A1 Jun. 1, 2023

(30) Foreign Application Priority Data

Nov. 29, 2021 (JP) ..... 2021-193254

(51) Int. Cl.
*G03G 15/08* (2006.01)

(52) U.S. Cl.
CPC ..... *G03G 15/0865* (2013.01)

(58) Field of Classification Search
CPC ..... G03G 15/0865
USPC ..... 399/119, 120, 343, 358–360
See application file for complete search history.

(56) References Cited

U.S. PATENT DOCUMENTS 9,436,127 B2 * 9/2016 Mitsuishi ..... G03G 15/0872

FOREIGN PATENT DOCUMENTS

JP 2008209854 A 9/2008

* cited by examiner

*Primary Examiner* — Hoan H Tran
(74) *Attorney, Agent, or Firm* — Alleman Hall Creasman & Tuttle LLP

(57) ABSTRACT

A developer storing apparatus according to the present disclosure includes a developer container and a container supporting portion that holds the developer container at a predetermined attachment position. The developer container includes a container body, an inlet, a first handle portion, and a second handle portion. The inlet is provided at a container upper portion of the container body, at a position near a first end portion on a side of an insertion direction of the developer container. From the inlet, the developer is caused to flow inside the container body. The first handle portion is provided at the container upper portion of the container body. The second handle portion is provided at a second end portion of the container body on a side of a draw-out direction opposite to the insertion direction.

8 Claims, 14 Drawing Sheets

DEVELOPER STORING APPARATUS AND IMAGE FORMING APPARATUS

INCORPORATION BY REFERENCE

This application is based upon and claims the benefit of priority from the corresponding Japanese Patent Application No. 2021-193254 filed on Nov. 29, 2021, the entire contents of which are incorporated herein by reference.

BACKGROUND

The present disclosure relates to a developer storing apparatus including a developer container capable of storing used developer, and an image forming apparatus including the developer storing apparatus.

Generally, an image forming apparatus that uses electrophotography includes a developer container that collects and retains used developer that has been used by an imaging portion (hereinafter, referred to as "waste developer"). The developer container is attached to an attachment portion provided in the image forming apparatus in an attachable/detachable manner so as to replaceable.

SUMMARY

A developer storing apparatus according to an aspect of the present disclosure includes: a developer container capable of storing used developer collected inside an image forming apparatus; and a container supporting portion that is provided in the image forming apparatus and holds, at a predetermined attachment position, the developer container inserted into the image forming apparatus from an opening formed on a side surface of the image forming apparatus. The developer container includes a container body, an inlet, a first handle portion, and a second handle portion. The inlet is provided at a container upper portion of the container body, at a position near a first end portion on a side of an insertion direction of the developer container. From the inlet, the developer is caused to flow inside the container body. The first handle portion is provided at the container upper portion of the container body. The second handle portion is provided at a second end portion of the container body on a side of a draw-out direction opposite to the insertion direction.

An image forming apparatus according to another aspect of the present disclosure includes: an apparatus body; an image forming portion that forms a developer image formed of developer on an image-carrying member; a cleaning portion that removes used developer remaining on the image-carrying member; a developer container capable of storing the used developer removed by the cleaning portion; and a container supporting portion that holds, at a predetermined attachment position, the developer container inserted into the apparatus body from an opening formed on a side surface of the apparatus body. The developer container includes a container body, an inlet, a first handle portion, and a second handle portion. The inlet is provided at a container upper portion of the container body, at a position near a first end portion on a side of an insertion direction of the developer container. From the inlet, the developer is caused to flow inside the container body. The first handle portion is provided at the container upper portion of the container body. The second handle portion is provided at a second end portion of the container body on a side of a draw-out direction opposite to the insertion direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the attached drawings as appropriate. It is noted that the following embodiments are embodied examples of the present disclosure and do not limit the technical scope of the present disclosure. It is noted that for convenience of descriptions, an up-down direction D1, a front-rear direction D2, and a left-right direction D3 are defined in a state where an image forming apparatus 10 is installed in a usable state (state shown in FIG. 1).

Figure 1:
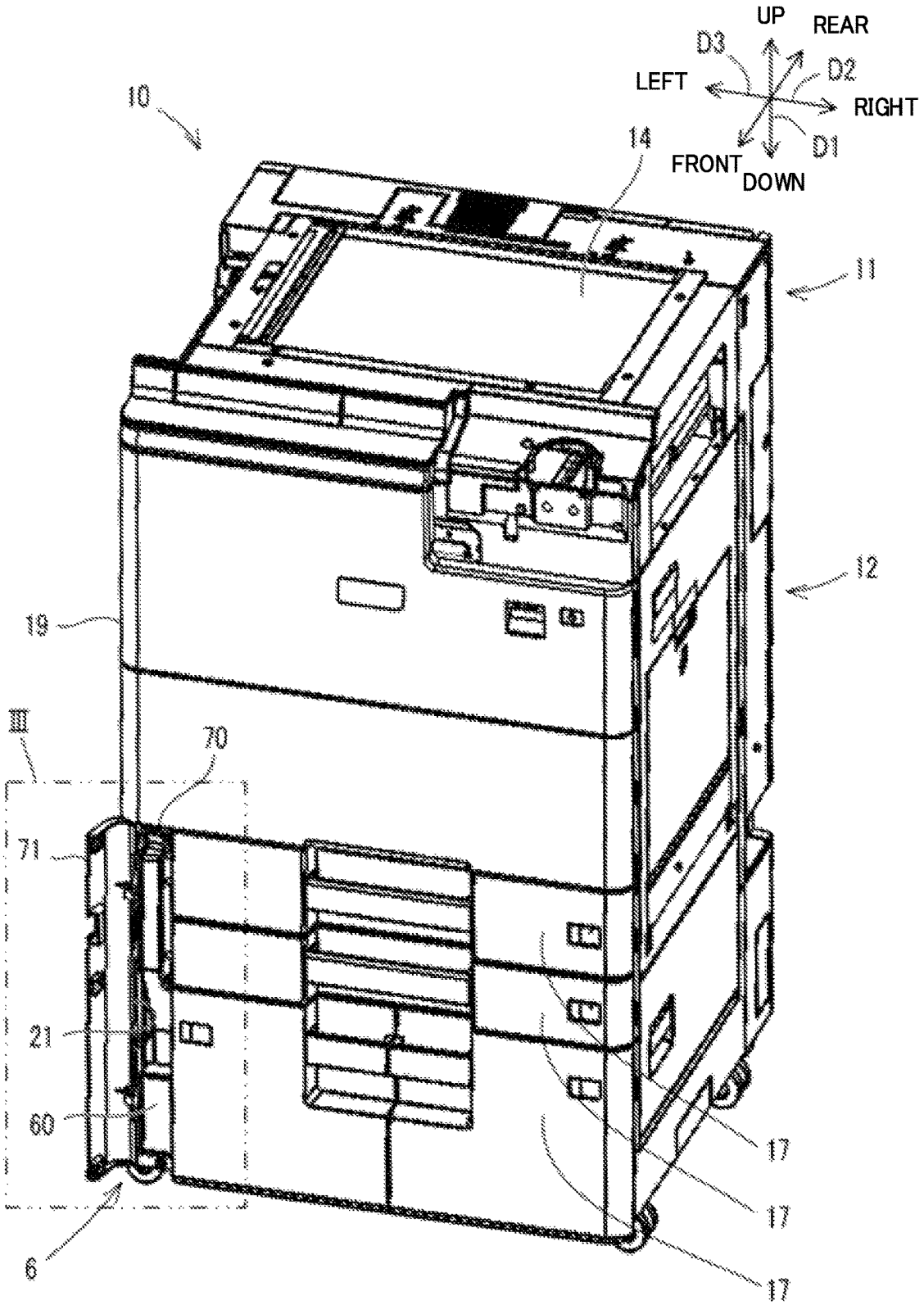
FIG. 1 is a perspective view showing a configuration of an image forming apparatus according to an embodiment of the present disclosure.

Referring to FIG. 1, a configuration of the image forming apparatus 10 (an example of an image forming apparatus according to the present disclosure) will be described. Herein, FIG. 1 is a perspective view of the image forming apparatus 10 according to an embodiment of the present disclosure. It is noted that an illustration of a document sheet cover provided at an upper portion of the image forming apparatus 10 is omitted.

The image forming apparatus 10 is a multifunction peripheral including a printing function, a copying function, a scanning function, a facsimile function, and the like. As shown in FIG. 1, the image forming apparatus 10 includes an image reading apparatus 11, an image forming portion 12, and the like.

The image reading apparatus 11 is an apparatus that reads an image of a document sheet placed on a document sheet placing table 14. The image reading apparatus 11 is provided at an upper portion of the image forming apparatus 10. The image reading apparatus 11 includes the document sheet placing table 14, a reading unit (not shown), a document sheet holder (not shown), and the like. The image reading apparatus 11 carries out processing of reading an image from a still document sheet placed on the document sheet placing table 14.

In this embodiment, descriptions will be given while exemplifying the image forming apparatus 10 including the image reading apparatus 11, but the present disclosure is not limited thereto. For example, the present disclosure is also applicable to a printer (image forming apparatus) including only a printing function for forming an image on a sheet using developer.

The image forming portion 12 forms a color or monochrome image on a sheet by electrophotography based on image data read by the image reading apparatus 11 or image data input from an information processing apparatus such as an external personal computer. The sheet is a sheet-type image forming medium (transfer medium) such as paper and an envelope. The sheet on which an image is formed is discharged to a sheet discharge tray (not shown).

It is noted that in this embodiment, descriptions will be given while exemplifying the image forming portion 12 that uses electrophotography, but the image forming portion 12 is not limited to the one that uses electrophotography and may adopt any recording system or printing system as long as it can form an image using developer such as toner.

Figure 2:
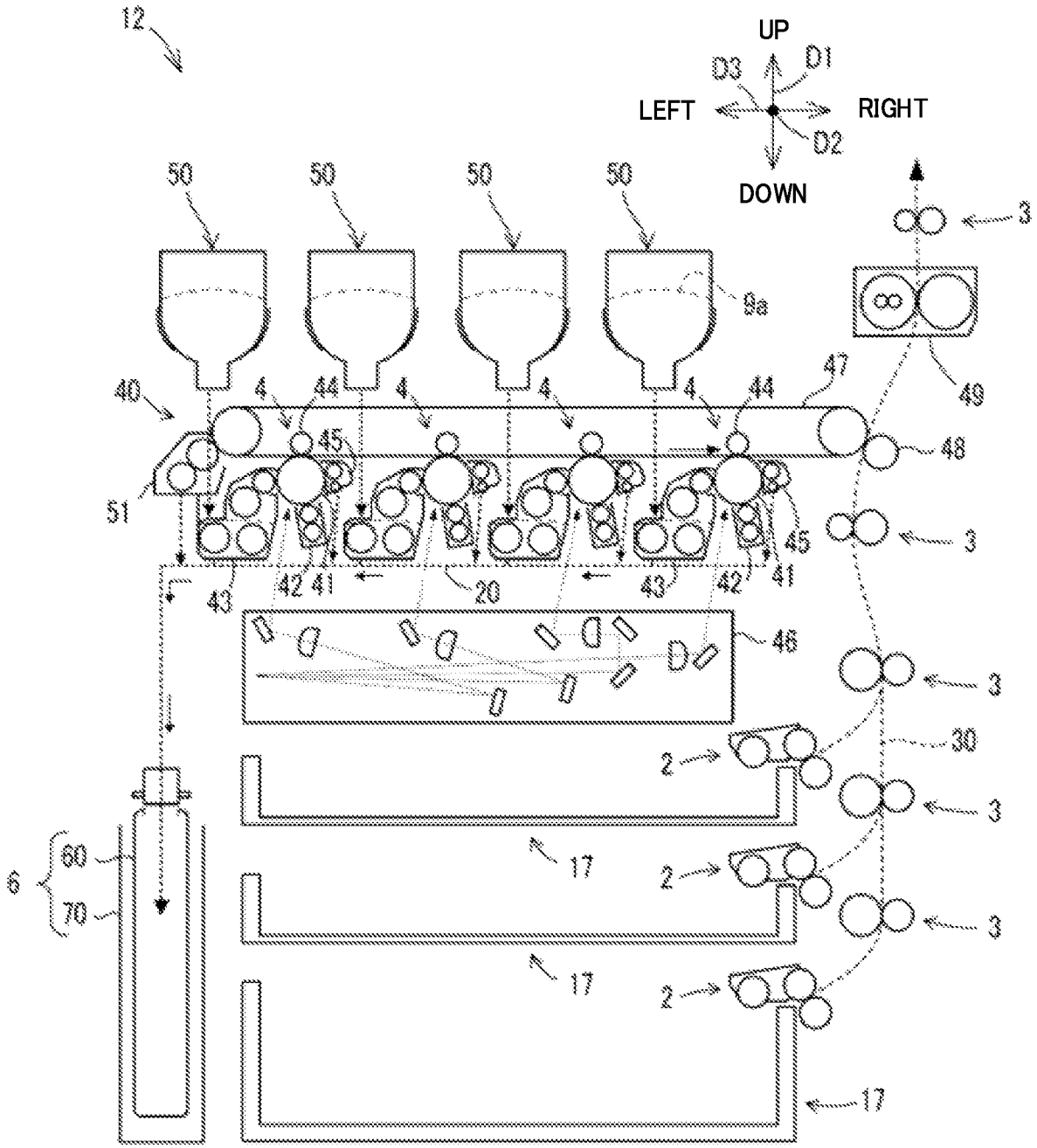
FIG. 2 is a schematic diagram showing an internal configuration of the image forming apparatus.

FIG. 2 is a schematic diagram showing a configuration of the image forming portion 12. As shown in FIG. 2, the image forming portion 12 includes a housing 19 as an apparatus body, sheet storing portions 17, sheet feed portions 2, sheet conveying portions 3, an imaging portion 40 (an example of an imaging portion according to the present disclosure), a laser scanning portion 46, a fixing portion 49, toner supplying portions 50, and a waste toner storing apparatus 6 (an example of a developer storing apparatus according to the present disclosure).

The imaging portion 40 executes image forming processing for forming an image on a sheet using developer. The imaging portion 40 includes image forming units 4, a device used for development, a device used for conveying the developer, and the like. The developer is two-component developer including toner and a carrier.

The imaging portion 40 includes a plurality of image forming units 4 respectively corresponding to toner of a plurality of colors, an intermediate transfer belt 47 (an example of an image-carrying member according to the present disclosure), a secondary transfer portion 48, and a belt cleaning portion 51 (an example of a cleaning portion according to the present disclosure). A plurality of toner supplying portions 50 are also provided for the respective toner colors. In this embodiment, the imaging portion 40 includes four image forming units 4.

Each of the image forming units 4 includes a photoconductor drum 41 (an example of an image-carrying member according to the present disclosure), a charging portion 42, a developing portion 43, a primary transfer portion 44, and a drum cleaning portion 45, (an example of a cleaning portion according to the present disclosure). In each of the image forming units 4 of the imaging portion 40, the developing portion 43 forms a toner image (an example of a developer image) on an outer circumferential surface of the photoconductor drum 41. Further, in the imaging portion 40, the primary transfer portion 44 forms the toner image formed on the photoconductor drum 41 on the intermediate transfer belt 47.

The sheet storing portion 17 stores sheets to be fed by the sheet feed portion 2. The sheet feed portion 2 takes out a sheet from the sheet storing portion 17 and feeds the sheet to a sheet conveying path 30. The sheet conveying portion 3 conveys the sheet fed by the sheet feed portion 2 toward a downstream side of a sheet feed direction along the sheet conveying path 30. The intermediate transfer belt 47 is an endless belt-like member which is rotated while being bridged between two rollers.

In each of the image forming units 4, the drum-type photoconductor drum 41 is rotated so that the charging portion 42 uniformly charges a surface of the photoconductor drum 41. The laser scanning portion 46 scans laser light so as to write an electrostatic latent image on the surface of the photoconductor drum 41.

The developing portion 43 develops the electrostatic latent image into a toner image using developer including a carrier retained in advance and unused toner supplied from the toner supplying portion 50. Accordingly, the toner image is formed on the surface of the photoconductor drum 41.

The primary transfer portion 44 transfers the toner image formed on the surface of the photoconductor drum 41 onto the intermediate transfer belt 47. Thus, toner images are respectively transferred onto the intermediate transfer belt 47 from the plurality of photoconductor drums 41. Accordingly, a color toner image obtained by superimposing the toner images of the respective colors is formed on the intermediate transfer belt 47.

The secondary transfer portion 48 transfers the color toner image formed on the intermediate transfer belt 47 onto the sheet. The fixing portion 49 fixes the color toner image onto the sheet by heating. After that, the sheet onto which the image is fixed is discharged to the sheet discharge tray (not shown).

The drum cleaning portion 45 removes toner remaining on the surface of the photoconductor drum 41 (used toner) after the transfer by the primary transfer portion 44. The drum cleaning portion 45 includes, for example, a cleaning member such as a cleaning blade and a cleaning roller, which comes into contact with the surface of the photoconductor drum 41 to remove the used toner, and a conveying member such as a spiral shaft, which is provided inside a housing of the drum cleaning portion 45. By the conveying member being driven by a driving portion (not shown) such as a motor, the conveying member conveys the toner accumulated at a bottom portion of the housing to a conveying path 20 (see FIG. 2) in the housing 19.

The belt cleaning portion 51 removes the toner remaining on a surface of the intermediate transfer belt 47 (used toner) after the transfer by the secondary transfer portion 48. The belt cleaning portion 51 includes, for example, a cleaning member such as a cleaning blade and a cleaning roller, which comes into contact with the surface of the intermediate transfer belt 47 to remove the used toner, and a conveying member such as a spiral shaft, which is provided inside a housing of the belt cleaning portion 51. By the conveying member being driven by the driving portion (not shown) such as a motor, the conveying member conveys the toner accumulated at a bottom portion of the housing to the conveying path 20.

The used toner conveyed from the drum cleaning portion 45 and the belt cleaning portion 51 to the conveying path 20 is an example of used developer according to the present disclosure. The used toner is toner to be discarded or recycled and will hereinafter be referred to as waste toner.

A toner conveying member for conveying the waste toner to the waste toner storing apparatus 6 is provided on the conveying path 20. By the toner conveying member being driven by the driving portion (not shown) such as a motor, the waste toner in the conveying path 20 is conveyed toward the waste toner storing apparatus 6.

The waste toner storing apparatus 6 includes a collection container 60 (an example of a developer container according to the present disclosure) for storing the waste toner and a container attachment portion 70 (an example of a container supporting portion according to the present disclosure) that supports the collection container 60. The waste toner removed from the photoconductor drums 41 and the intermediate transfer belt 47 by the drum cleaning portions 45 and the belt cleaning portion 51 is conveyed to the waste toner storing apparatus 6 to be stored inside the collection container 60.

Figure 3:
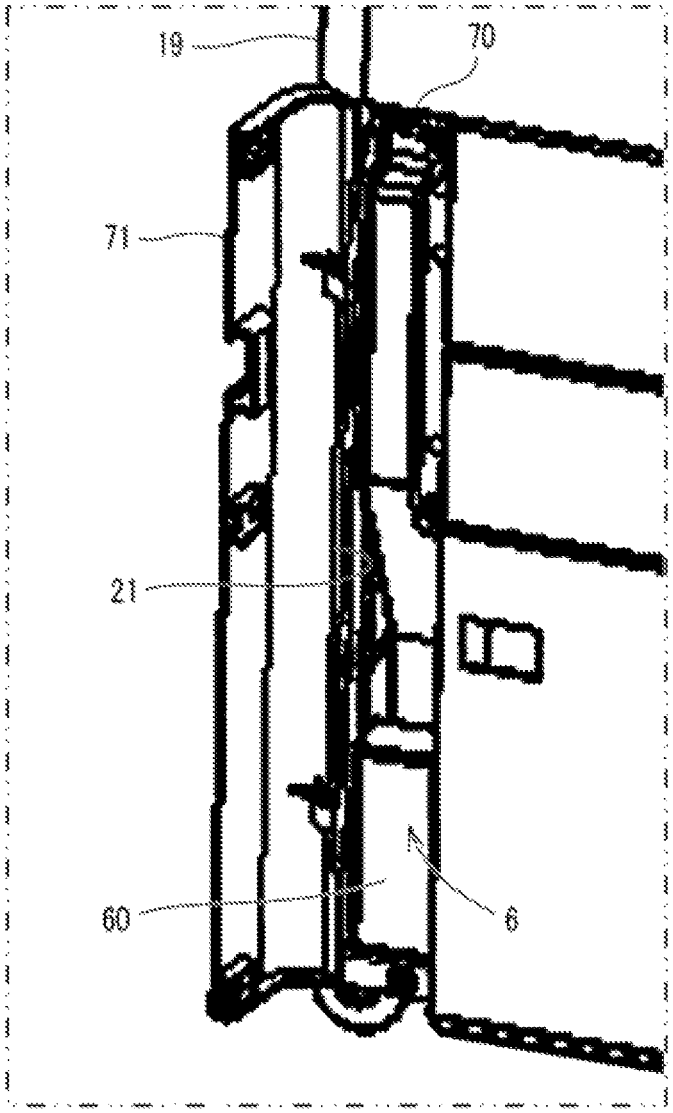
FIG. 3 is a partially-enlarged view of a main portion III shown in FIG. 1, which shows a peripheral configuration of a container attachment portion provided in the image forming apparatus.

FIG. 3 is a partially-enlarged diagram showing a peripheral configuration of the container attachment portion 70. As shown in FIG. 3, the container attachment portion 70 is provided at a left end portion of a front-side lower portion in the housing 19.

The housing 19 includes an opening 21 at a lower portion of the front-side left end portion. The opening 21 is formed in a rectangular shape in which a length thereof in the left-right direction D3 is small and a length thereof in the up-down direction D1 is large. The container attachment portion 70 is provided rearwardly from the opening 21.

Figure 4:
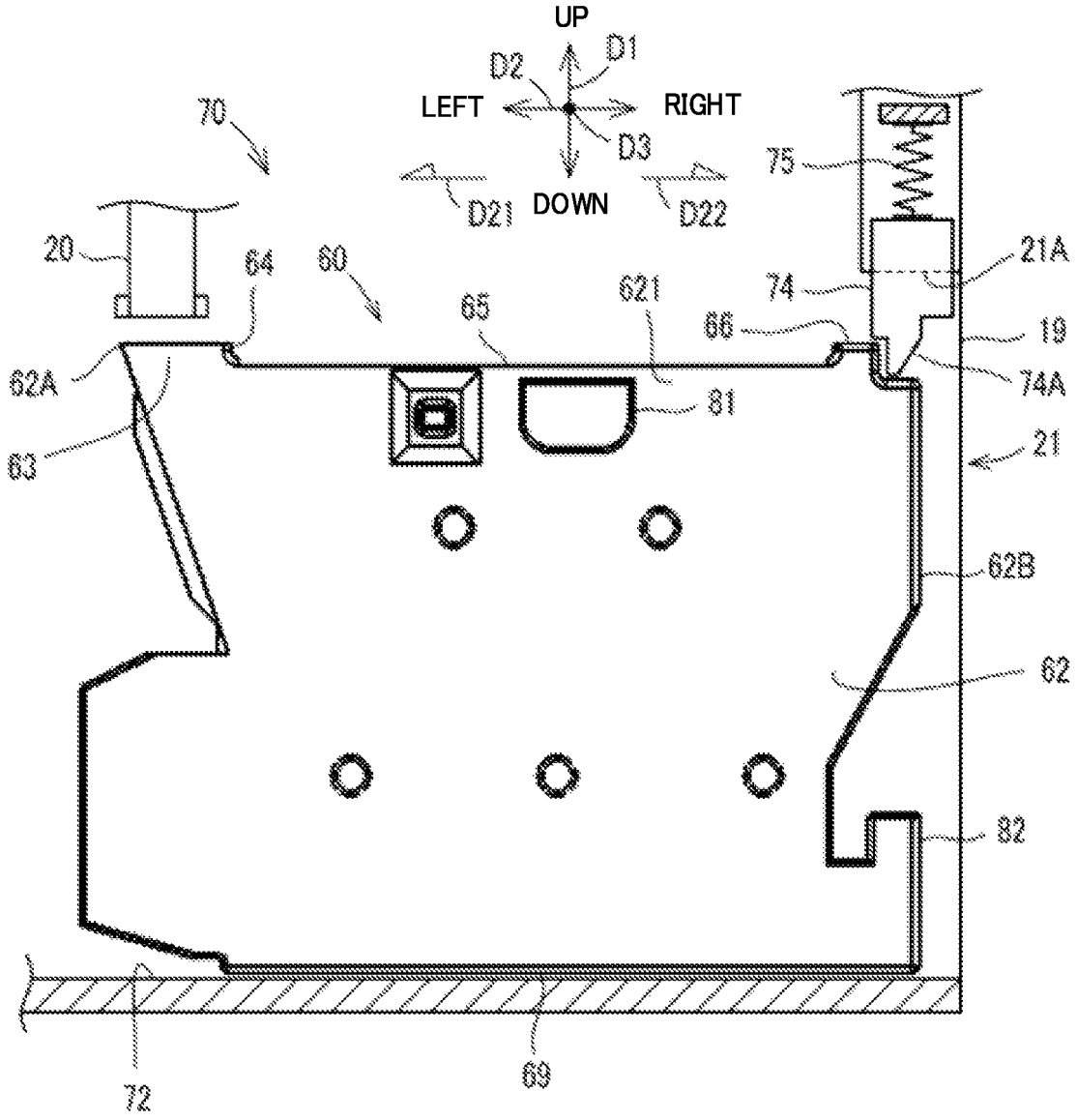
FIG. 4 is a side view schematically showing a configuration of the container attachment portion to which a collection container is attached.

The container attachment portion 70 holds the collection container 60 inserted therein from the opening 21 at a predetermined attachment position (position shown in FIG. 4). The container attachment portion 70 supports the collection container 60 in an attachable/detachable manner.

As shown in FIG. 3, the container attachment portion 70 includes a cover 71 that is displaced between a closing position at which the cover 71 closes the opening 21 and an opening position at which the cover 71 opens the opening 21. The cover 71 rotates between the closing position and the opening position using a hinge portion (not shown) provided at a left edge portion of the opening 21 as a rotation fulcrum, to open and close the opening 21. By providing the cover 71, the collection container 60 is exposed to the outside from the opening 21. Accordingly, a user can grasp a handle provided at a front end portion of the collection container 60 and draw out the collection container 60 from the container attachment portion 70.

Figure 5:
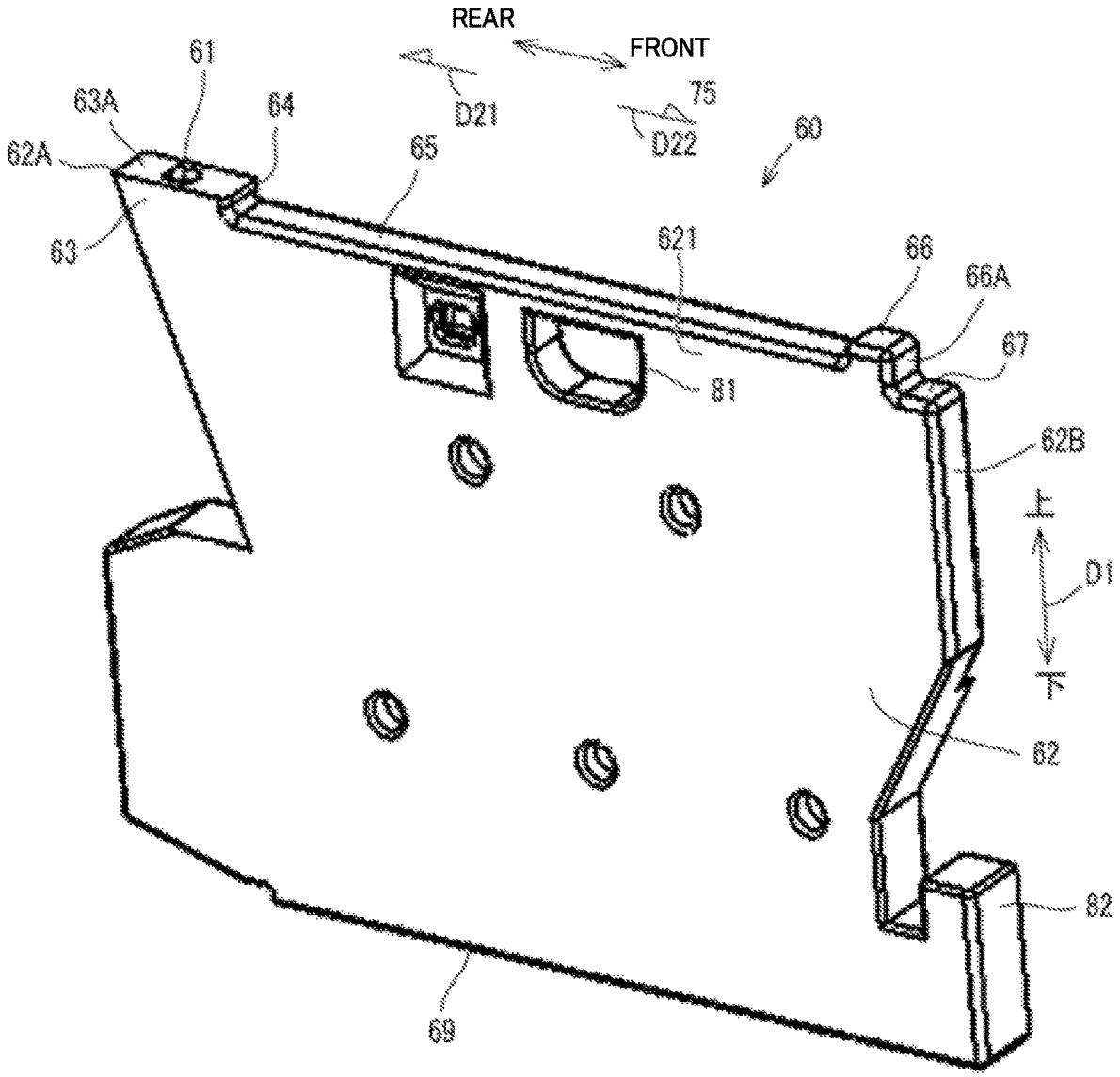
FIG. 5 is a perspective view showing a configuration of the collection container.
Figure 6:
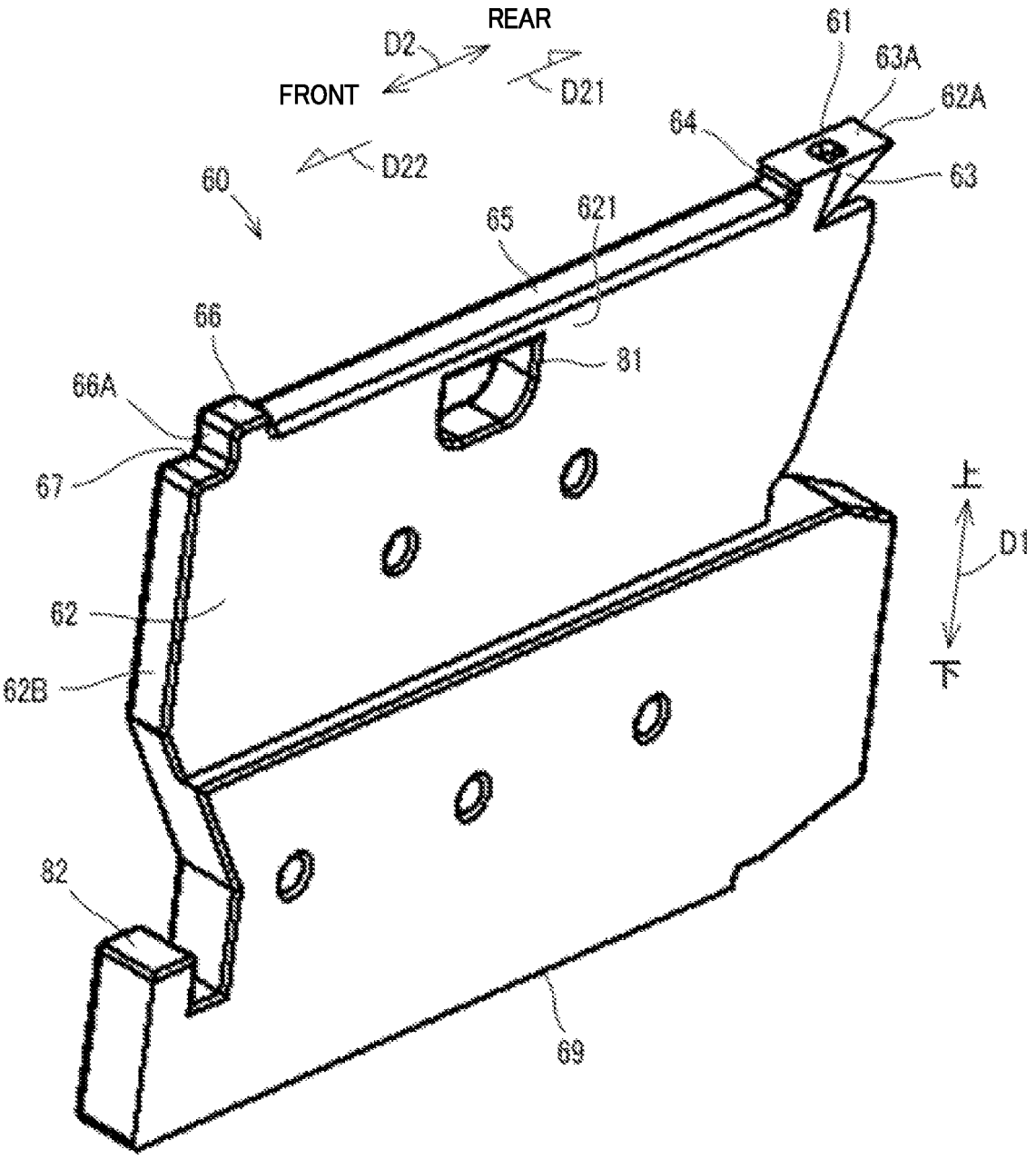
FIG. 6 is a perspective view showing the configuration of the collection container.
Figure 7A:
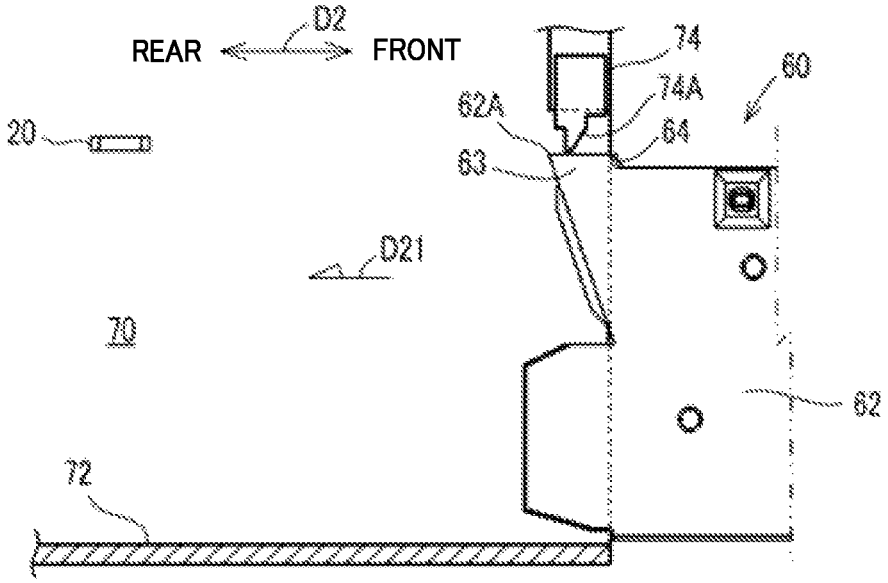
FIG. 7A is a diagram showing an attachment operation of the collection container.
Figure 7B:
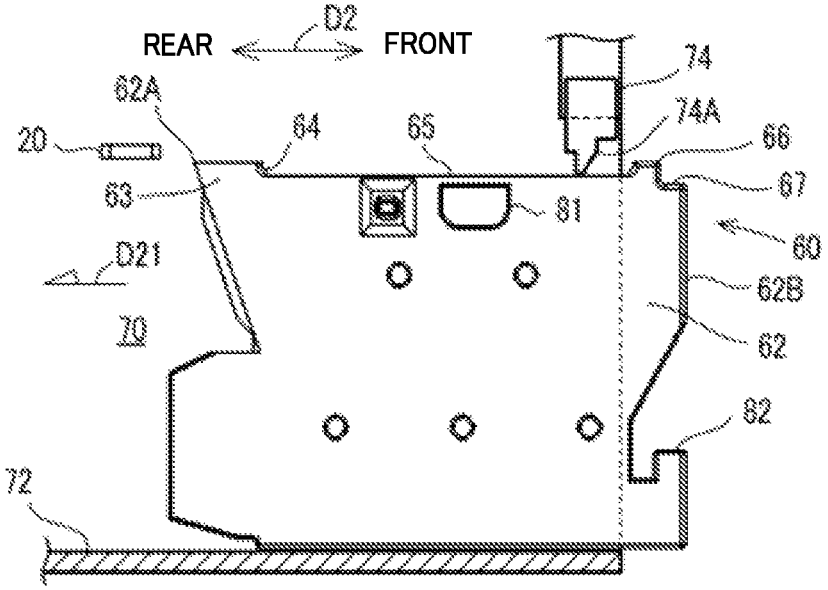
FIG. 7B is a diagram showing the attachment operation of the collection container.
Figure 7C:
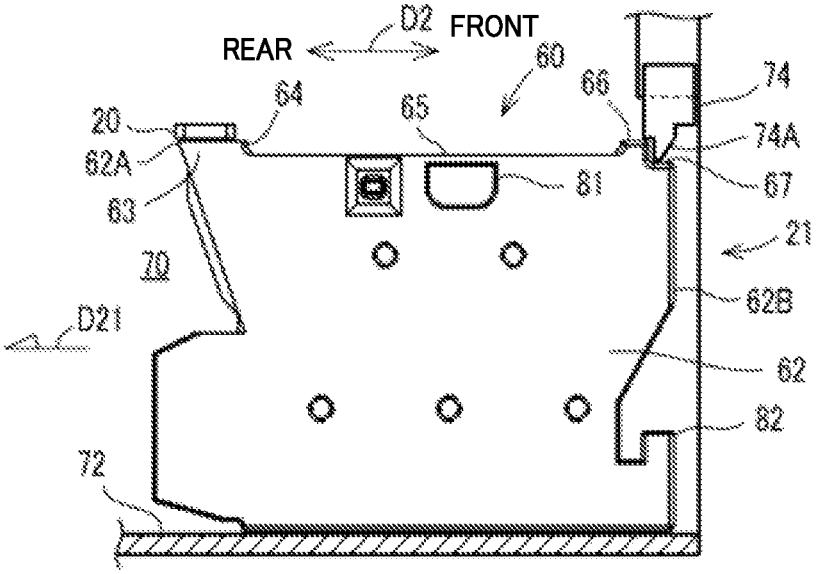
FIG. 7C is a diagram showing the attachment operation of the collection container.
Figure 8A:
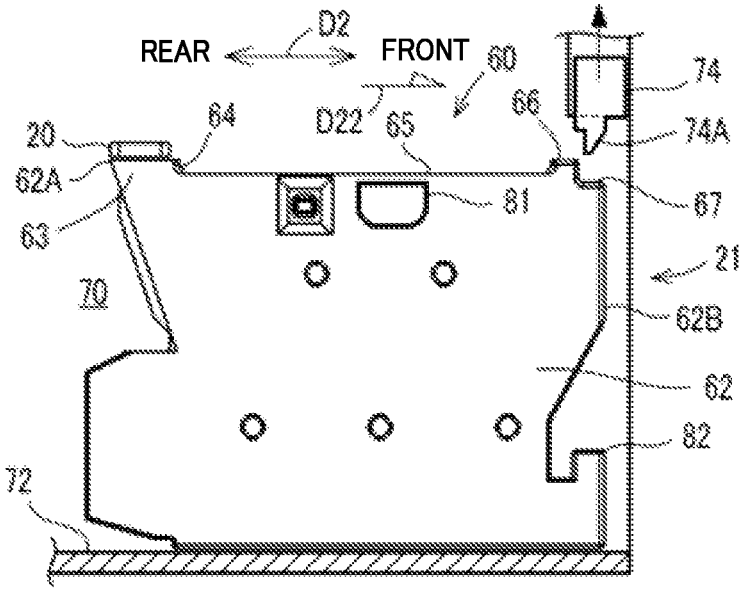
FIG. 8A is a diagram showing a removal operation of the collection container.
Figure 8B:
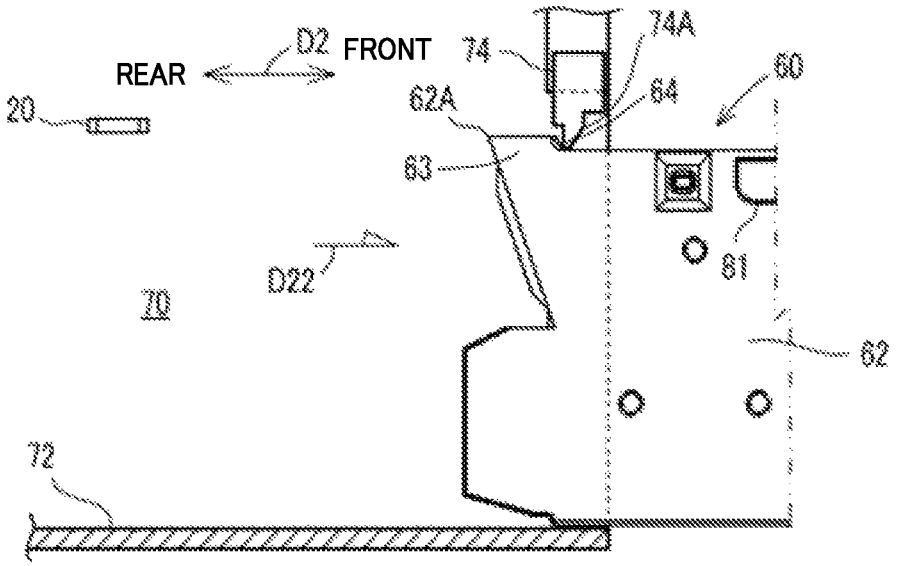
FIG. 8B is a diagram showing the removal operation of the collection container.
Figure 8C:
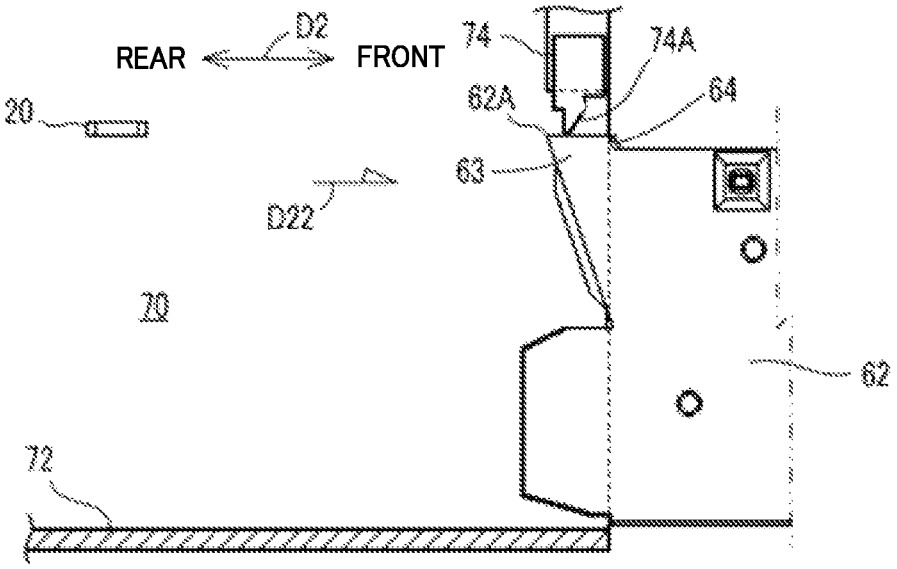
FIG. 8C is a diagram showing the removal operation of the collection container.

FIG. 4 is a side view schematically showing a configuration of the container attachment portion 70. FIG. 4 shows a state where the collection container 60 is attached to the container attachment portion 70. FIG. 5 and FIG. 6 are each a perspective view showing the collection container 60. In FIG. 5 and FIG. 6, the up-down direction D1, the front-rear direction D2, and the left-right direction D3 are defined using an attachment attitude of the collection container 60 with respect to the container attachment portion 70 as a reference. FIG. 7A, FIG. 7B, and FIG. 7C are each a diagram showing an attachment operation of the collection container 60. FIG. 8A, FIG. 8B, and FIG. 8C are each a diagram showing a removal operation of the collection container 60.

As shown in FIG. 4, the container attachment portion 70 includes a bottom plate 72 that supports a bottom portion 69 of the collection container 60 and a lock member 74 (an example of a stopper member according to the present disclosure) that holds, at the attachment position, the collection container 60 attached at the attachment position.

The bottom plate 72 is a flat supporting plate that extends rearwardly from a lower end portion of the opening 21 and constitutes a part of a bottom plate of the housing 19. The bottom plate 72 supports the bottom portion 69 of the collection container 60 such that the collection container 60 is slidable in the front-rear direction D2.

The lock member 74 is provided in the housing 19. The lock member 74 is supported by an upper edge portion 21A of the opening 21 while being movable in the up-down direction D1. The lock member 74 is movably supported between a lock position (an example of a protrusion position according to the present disclosure) at which the lock member 74 protrudes downwardly from the upper edge portion 21A to lock the collection container 60 and a release position (an example of an evacuation position according to the present disclosure) at which the lock member 74 evacuates to the inside of the upper edge portion 21A to unlock the collection container 60. FIG. 4 shows a state where the lock member 74 is at the lock position.

In this embodiment, the lock member 74 is set at the lock position when the collection container 60 is in a container attachment state (state shown in FIG. 4) where the collection container 60 is attached at the attachment position of the container attachment portion 70. When the lock member 74 is at the lock position in the container attachment state, a lock piece 74A provided at a lower end portion of the lock member 74 comes into contact with a front surface portion 66A (see FIG. 5) of a first restriction portion 66 (an example of a first engagement portion according to the present disclosure) of the collection container 60. Accordingly, a forward movement of the collection container 60 from the attachment position is restricted. As a result, in the container attachment portion 70, the collection container 60 can be held stably at the attachment position. The first restriction portion 66 will be described later.

A front surface of the lock piece 74A is an inclined surface that is inclined forwardly in an upward oblique direction. Therefore, when a rear end portion 62A (an example of a first end portion according to the present disclosure) of an upper portion 621 (an example of a container upper portion according to the present disclosure) of a container body 62 comes into contact with the inclined surface during a process of inserting the collection container 60 toward the attachment position of the container attachment portion 70, the lock member 74 is raised upwardly by an inclined cam principle. Accordingly, the lock member 74 evacuates to the release position so that the collection container 60 can be smoothly inserted into the container attachment portion 70. It is noted that also by the user manually moving the lock member 74 upwardly, the lock member 74 can be evacuated to the release position.

Further, the lock member 74 is set at the lock position also during a container draw-out process of forwardly drawing out the collection container 60 from the attachment position of the container attachment portion 70. When the collection container 60 moves to a predetermined rear restriction position (position shown in FIG. 8B) apart from the attachment position in a draw-out direction D22 (front side) during the container draw-out process, the lock piece 74A comes into contact with a front surface portion (see FIG. 5) of a second restriction portion 64 (an example of a second engagement portion according to the present disclosure) of the collection container 60. Accordingly, a situation where the collection container 60 moves forwardly from the rear restriction position to be detached from the container attachment portion 70 is prevented from occurring. The second restriction portion 64 will be described later.

It is noted that the lock with respect to the second restriction portion 64 can be released by the user manually moving the lock member 74 upwardly.

Further, the container attachment portion 70 includes a bias member 75 (an example of a bias member according to the present disclosure) that biases the lock member 74 toward the lock position. The bias member 75 is, for example, a coil spring having an elasticity or an elastic member such as a sponge member and a rubber member. The bias member 75 applies an elastic force that presses the lock member 74 downwardly. Since the lock member 74 is pressed downwardly by such an elastic force, the collection container 60 is restricted at the attachment position or the rear restriction position for sure.

The collection container 60 is attached while being removable (attachable/detachable) from the container attachment portion 70 via the opening 21. The collection container 60 is a container that is hollow on the inside, and waste toner discharged from the imaging portion 40 is stored inside the collection container 60.

As shown in FIG. 5 and FIG. 6, the collection container 60 includes the container body 62 (an example of a container body according to the present disclosure) in which waste toner is accumulated, the first restriction portion 66, the second restriction portion 64, and a flow inlet 61 (an example of an inlet according to the present disclosure) through which waste toner is guided to the inside.

The container body 62 is formed in a shape in which a size thereof in an insertion direction D21 and a size thereof in the up-down direction D1 are larger than a size thereof in a width direction (left-right direction D3) orthogonal to the insertion direction D21. In other words, the container body 62 has a small width in the left-right direction D3 and is long in the up-down direction D1 and the front-rear direction D2, and is thus formed in a shape that is flat in the width direction (left-right direction D3). Herein, the insertion direction D21 is a direction in which the collection container 60 is inserted toward a rear portion of the container attachment portion 70 from the opening 21 when attaching the collection container 60 to the container attachment portion 70.

The first restriction portion 66 is provided at the upper portion 621 of the container body 62. The first restriction portion 66 engages with the lock member 74 positioned at the lock position to restrict a forward movement of the collection container 60 from the attachment position.

The first restriction portion 66 is provided at the upper portion 621 of the container body 62, at a position on a side of the draw-out direction D22 (front side) of the collection container 60. The first restriction portion 66 is formed integrally with the container body 62. At an end portion of the upper portion 621 of the container body 62 in the draw-out direction D22, a step portion 67 that is a step lower than an upper surface portion 65 constituting an upper surface of the container body 62 is formed. The first restriction portion 66 protrudes upwardly so as to become higher than the step portion 67 and also become higher than the upper surface portion 65.

The flow inlet 61 is formed in a size and shape and at a position with/at which waste toner discharged from the imaging portion 40 via the conveying path 20 is capable of flowing in, in the attachment state where the collection container 60 is attached to the container attachment portion 70. In this embodiment, the flow inlet 61 is provided at the upper portion 621 of the container body 62, at a position communicable with an outlet provided at a lower end of the conveying path 20 in the attachment state. Specifically, the flow inlet 61 is formed in a table-like portion 63 provided at the upper portion 621 of the container body 62. The table-like portion 63 is provided near the rear end portion 62A of the upper portion 621, at a position on a rear side of the insertion direction D21 at the upper portion 621 of the container body 62. The flow inlet 61 is a through-hole formed on an upper surface 63A of the table-like portion 63, and penetrates toward the inside from the upper surface 63A of the table-like portion 63 in the up-down direction D1.

The upper portion 621 of the container body 62 includes the upper surface portion 65 that is a step lower than the upper surface 63A of the table-like portion 63. In other words, the table-like portion 63 protrudes upwardly from the upper surface of the upper surface portion 65. Specifically, the table-like portion 63 is a table-like portion that is raised upwardly from the upper surface of the upper surface portion 65, and the upper surface 63A thereof is a flat surface.

The second restriction portion 64 is provided between the table-like portion 63 and the upper surface portion 65. A step portion that extends from the upper surface portion 65 to the upper surface 63A of the table-like portion 63 is formed between the table-like portion 63 and the upper surface portion 65, and this step portion is the second restriction portion 64.

The second restriction portion 64 is provided at a position more on the insertion direction D21 side than the first restriction portion 66 at the upper portion 621 of the container body 62. More specifically, the second restriction portion 64 is provided near the flow inlet 61, at a position more on the insertion direction D21 side than the first restriction portion 66 and more on the draw-out direction D22 (front) side than the flow inlet 61.

Meanwhile, a conventional developer container is provided with a handle only on a front side in an attachment direction with respect to an attachment portion. Therefore, when a user holds the handle and draws out the conventional developer container from the attachment portion and thereafter lifts up the developer container in that state without any careful consideration, a tip end side of the developer container is inclined downwardly due to a weight of the developer container. In this case, there is a fear that waste toner will be spilled from a waste toner inlet provided at a container upper portion to thus smear a periphery of an insertion opening of the attachment portion or a floor surface by the waste toner.

In contrast, in this embodiment, the container body 62 is provided with two handles 81 and 82 as will be described later. Therefore, it becomes possible to grasp the collection container 60 for sure without causing it to be inclined when drawing out and removing the collection container 60 from the container attachment portion 70.

As shown in FIG. 5 and FIG. 6, the collection container 60 includes a first handle 81 (an example of a first handle portion according to the present disclosure) and a second handle 82 (an example of a second handle portion according to the present disclosure). Each of the handles 81 and 82 is formed integrally with the container body 62.

The first handle 81 is provided at the upper portion 621 of the container body 62. For example, the first handle 81 penetrates through the container body 62 in the width direction (left-right direction D3) at the upper portion 621 of the container body 62. Therefore, the user can easily grasp the upper portion 621 of the container body 62 by hooking a finger in the first handle 81 or the like. It is noted that a shape of the first handle 81 may be any shape as long as the user can grasp the first handle 81 with a hand, and may be, for example, a dented shape, a hook shape, or the like.

In this embodiment, the first handle 81 is formed substantially at a center portion of the upper portion 621 of the container body 62 in the front-rear direction D2. More specifically, the first handle 81 is formed at a position corresponding to a barycentric position of the container body 62 in a state where waste toner is accumulated to an upper limit position inside the container body 62. For example, the first handle 81 is formed on a vertical line that passes through the barycentric position at the upper portion 621 of the container body 62. Therefore, when grasping the first handle 81 to lift up the collection container 60, the user can lift up the collection container 60 as it is in the attachment attitude of the collection container 60 with respect to the container attachment portion 70, without causing the collection container 60 to be thrown off balance in the front-rear direction D2.

Further, it is preferable for a positional relationship between the first handle 81 and the second restriction portion 64 to be a positional relationship in which the first handle 81 is exposed to the outside from the opening 21 in a state where the collection container 60 is drawn out from the attachment position of the container attachment portion 70 and the second restriction portion 64 is engaged with the lock member 74. Accordingly, when the collection container 60 is restricted at the rear restriction position, the user can easily switch the holding position from the second handle 82 to the first handle 81.

The second handle 82 is a portion grasped by the user when drawing out the collection container 60 positioned at the attachment position, and is provided at a front end portion 62B (an example of a second end portion according to the present disclosure) on the draw-out direction D22 side of the container body 62.

For example, the second handle 82 is formed at a lower end portion of the front end portion 62B. As shown in FIG. 6, the second handle 82 is formed in an upward hook shape so that the user can easily hook a finger from above. In this embodiment, a portion of the front end portion 62B lower than a vicinity of a center position of the front end portion 62B in the up-down direction D1 is formed to be concaved rearwardly toward the inside, and a hook portion is formed so as to protrude forwardly from the lower end portion of the front end portion 62B. Therefore, in a side view, a front surface of the second handle 82 and a front surface of the front end portion 62B are on the same plane.

Since the collection container 60 is configured as described above, when the collection container 60 is inserted into the opening 21 as shown in FIG. 7A, the rear end portion 62A of the container body 62 comes into contact with the inclined surface as the front surface of the lock piece 74A. Accordingly, the lock member 74 is raised upwardly so as to enable the collection container 60 to be inserted toward the rear side of the opening 21.

Then, when the collection container 60 is further inserted, the lock member 74 passes over the table-like portion 63 to come to the upper surface portion 65 (see FIG. 7B). The upper surface portion 65 is a flat surface extending in the front-rear direction D2. During the process of inserting the collection container 60 in the insertion direction D21, the lock piece 74A of the lock member 74 slides on the upper surface portion 65.

When the collection container 60 is further inserted in the insertion direction D21, a rear surface portion (a surface on an opposite side of the front surface portion 66A) of the first restriction portion 66 of the container body 62 comes into contact with the inclined surface of the lock piece 74A, and thus the lock member 74 is raised upwardly by the inclined cam principle. Then, when the collection container 60 reaches the attachment position, the lock member 74 passes over the first restriction portion 66 to engage with the first restriction portion 66. Accordingly, the forward movement of the collection container 60 from the attachment position is restricted.

Moreover, when drawing out the collection container 60 from the container attachment portion 70, the user manually moves the lock member 74 upwardly to release the lock with respect to the first restriction portion 66 (see FIG. 8A). In that state, the user grasps the second handle 82 of the collection container 60 to pull out the collection container 60 in the draw-out direction D22 and forwardly draw out the collection container 60.

When the collection container 60 is drawn out toward the draw-out direction D22 (front) side and reaches the rear restriction position (position shown in FIG. 8B), the lock piece 74A of the lock member 74 comes into contact with the second restriction portion 64 so that the lock piece 74A engages with the second restriction portion 64 (see FIG. 8B). Accordingly, the collection container 60 is caught at the rear restriction position so that the forward movement thereof from the rear restriction position is restricted.

Further, by the collection container 60 being caught at the rear restriction position, the user is given a chance to switch the handle. In other words, the user can be given a chance to change the position of holding the collection container 60 from the second handle 82 to the first handle 81. In this case, even when not intending to switch the handle of the collection container 60, by the collection container 60 being caught at the rear restriction position during the process of drawing out the collection container 60, the user can be given a trigger for switching the handle.

Furthermore, since the first handle 81 is exposed to the outside from the opening 21 in a state where the collection container 60 is positioned at the rear restriction position, the first handle 81 comes into sight of the user him/herself during the process of drawing out the collection container 60. Accordingly, the user can easily notice the first handle 81, with the result that a mind to switch the handle from the second handle 82 to the first handle 81 works.

Then, after changing the handle from the second handle 82 to the first handle 81, the user manually moves the lock member 74 upwardly again to release the lock with respect to the second restriction portion 64 (see FIG. 8C). In that state, the user draws out the collection container 60 in the draw-out direction D22 while grasping the first handle 81 of the collection container 60 so that the collection container 60 can be fully removed from the container attachment portion 70. At this time, since the user is grasping the first handle 81, the collection container 60 can be lifted up without causing a rear side of the collection container 60 to be inclined downwardly. Accordingly, a situation where waste toner is spilled from the flow inlet 61 is prevented from occurring.

Figure 9:
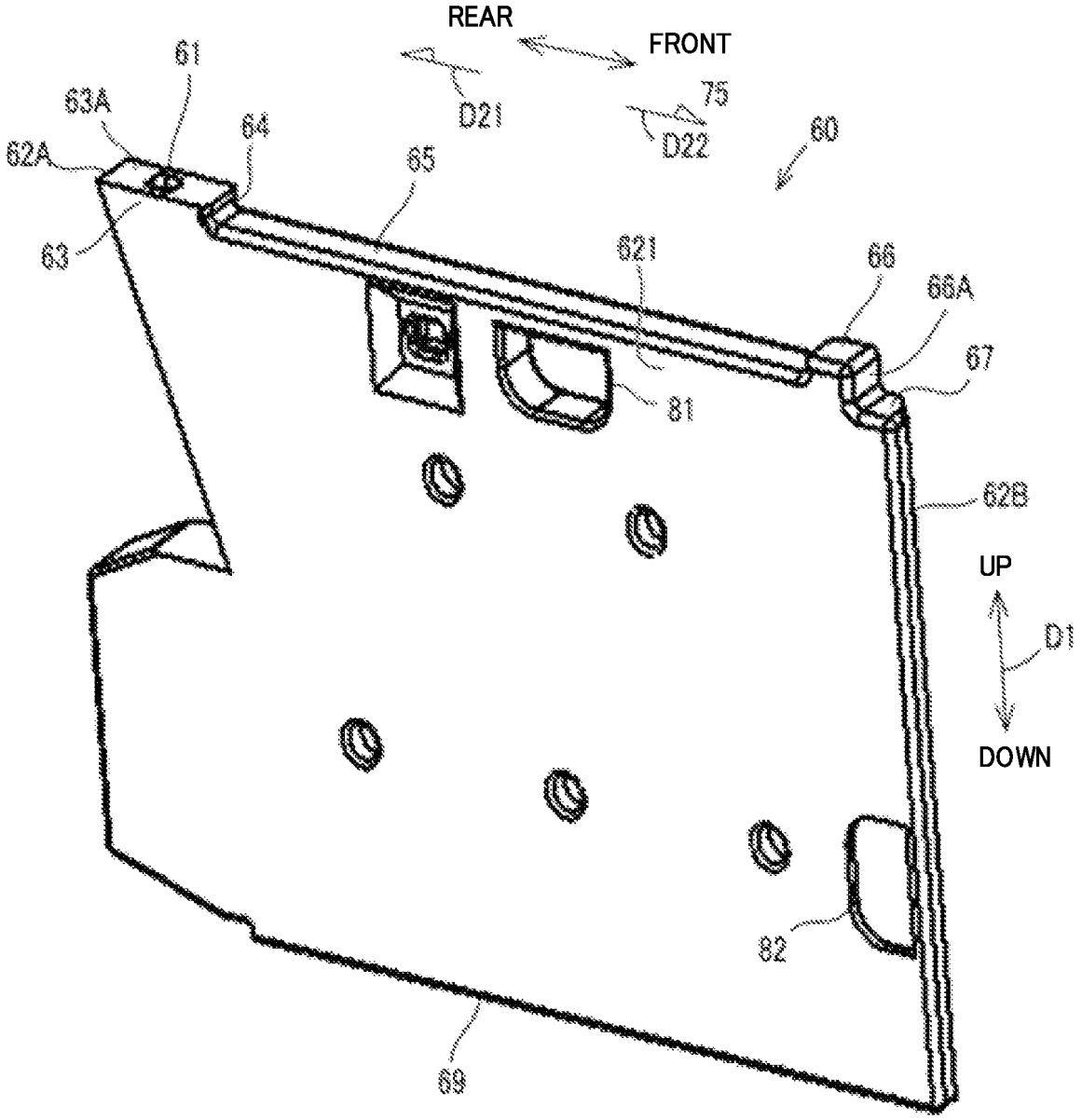
FIG. 9 is a perspective view showing a configuration of a collection container according to another embodiment of the present disclosure.
Figure 10:
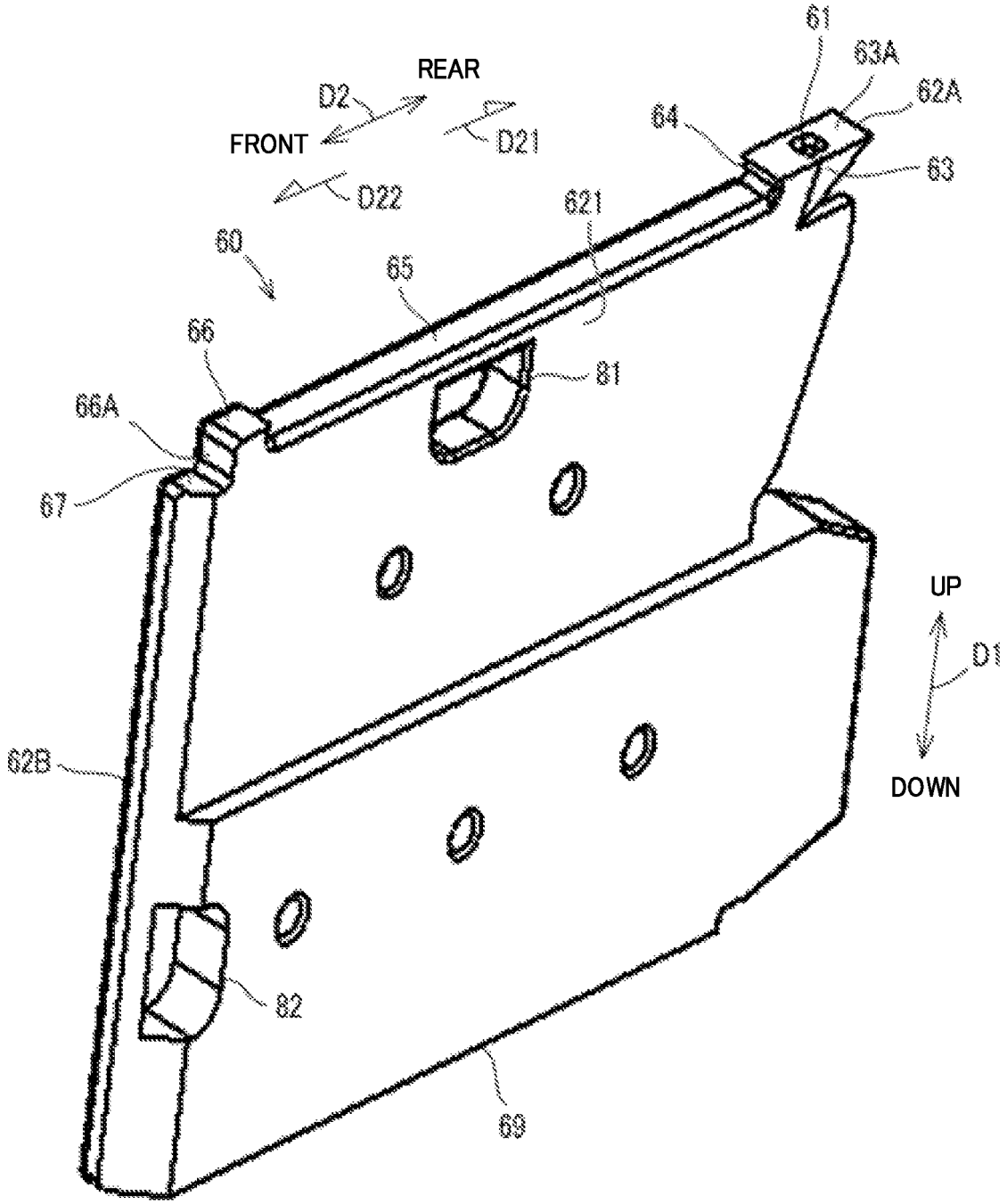
FIG. 10 is a perspective view showing a configuration of a collection container according to another embodiment of the present disclosure.

It is noted that in the embodiment described above, the second handle 82 having the hook shape shown in FIG. 5 and FIG. 6 has been exemplified. However, the shape of the second handle 82 is not limited to the hook shape shown in FIG. 5 and FIG. 6. For example, the second handle 82 may have a shape that penetrates through the vicinity of the front end portion 62B of the container body 62 in the width direction (left-right direction D3) as shown in FIG. 9 and FIG. 10. In this case, the second handle 82 is preferably formed at the front end portion 62B, at a position lower than the center portion of the front end portion 62B so as to enable the collection container 60 to be drawn out easily. In addition, the second handle 82 may be of any shape as long as it can be grasped by a hand of the user, and may be formed in, for example, a dented shape.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developer storing apparatus, comprising:

a developer container capable of storing used developer collected inside an image forming apparatus; and a container supporting portion that is provided in the image forming apparatus and holds, at a predetermined attachment position, the developer container inserted into the image forming apparatus from an opening formed on a side surface of the image forming apparatus, wherein the developer container includes a container body, an inlet from which the developer is caused to flow inside the container body, the inlet being provided at a container upper portion of the container body, at a position near a first end portion on a side of an insertion direction of the developer container, a first handle portion provided at the container upper portion of the container body, and a second handle portion provided at a second end portion of the container body on a side of a draw-out direction opposite to the insertion direction.

2. The developer storing apparatus according to claim 1, wherein the first handle portion is provided at a position corresponding to a barycenter of the developer container at the container upper portion.

3. The developer storing apparatus according to claim 1, wherein the container supporting portion includes a stopper member that is movably supported between a protrusion position at which the stopper member protrudes toward the container upper portion and an evacuation position at which the stopper member is set apart from the container upper portion, and the developer container includes a first engagement portion that is provided at the container upper portion and engages with the stopper member positioned at the protrusion position to restrict a movement of the developer container in the draw-out direction, and a second engagement portion that is provided more on the side of the insertion direction than the first engagement portion at the container upper portion and engages with the stopper member positioned at the protrusion position to restrict the movement of the developer container in the draw-out direction.

4. The developer storing apparatus according to claim 3, wherein the second engagement portion is provided near the inlet, at a position more on the side of the draw-out direction than the inlet at the container upper portion.

5. The developer storing apparatus according to claim 3, wherein the container supporting portion further includes a bias member that biases the stopper member toward the protrusion position.

6. The developer storing apparatus according to claim 3, wherein the first handle portion is exposed to outside from the opening in a state where the developer container is drawn out from the attachment position and the second engagement portion is engaged with the stopper member.

7. The developer storing apparatus according to claim 1, wherein the container body is formed in a shape in which a size of the container body in the insertion direction and a size of the container body in an up-down direction are larger than a size of the container body in a width direction orthogonal to the insertion direction.

8. An image forming apparatus, comprising:

an apparatus body;

an imaging portion that forms a developer image formed of developer on an image-carrying member;

a cleaning portion that removes used developer remaining on the image-carrying member;

a developer container capable of storing the used developer removed by the cleaning portion; and a container supporting portion that holds, at a predetermined attachment position, the developer container inserted into the apparatus body from an opening formed on a side surface of the apparatus body, wherein the developer container includes a container body, an inlet from which the developer is caused to flow inside the container body, the inlet being provided at a container upper portion of the container body, at a position near a first end portion on a side of an insertion direction of the developer container, a first handle portion provided at the container upper portion of the container body, and a second handle portion provided at a second end portion of the container body on a side of a draw-out direction opposite to the insertion direction.

* * * * *